US010534288B2

(12) United States Patent
Hayashi et al.

(10) Patent No.: US 10,534,288 B2
(45) Date of Patent: Jan. 14, 2020

(54) DEVELOPING DEVICE, PROCESS CARTRIDGE, AND IMAGE FORMING APPARATUS

(71) Applicant: CANON KABUSHIKI KAISHA, Tokyo (JP)

(72) Inventors: Kodai Hayashi, Suntou-gun (JP); Shinichi Agata, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/118,116

(22) Filed: Aug. 30, 2018

(65) Prior Publication Data

US 2019/0094754 A1 Mar. 28, 2019

(30) Foreign Application Priority Data

Sep. 25, 2017 (JP) ..... 2017-183525

(51) Int. Cl.
*G03G 15/08* (2006.01)
*G03G 21/18* (2006.01)

(52) U.S. Cl.
CPC ..... *G03G 15/0865* (2013.01); *G03G 21/18* (2013.01)

(58) Field of Classification Search
CPC ..... G03G 15/0865; G03G 21/18
See application file for complete search history.

(56) References Cited

U.S. PATENT DOCUMENTS

2001/0008591 A1* 7/2001 Kaneshige ..... G03G 15/0822 399/258
2013/0308988 A1* 11/2013 Hirukawa ..... G03G 15/0877 399/281
2018/0203378 A1* 7/2018 Egami ..... G03G 15/0865

FOREIGN PATENT DOCUMENTS

JP 2009025662 A 2/2009
JP 2016105200 A 6/2016
JP 2017032736 A 2/2017

* cited by examiner

*Primary Examiner* — Gregory H Curran
(74) *Attorney, Agent, or Firm* — Canon U.S.A., Inc. IP Division

(57) ABSTRACT

A developing device includes developer, a developer bearing member, and a supply member that is in contact with the developer bearing member and supplies the developer. The developing device further includes a developing chamber in which the developer bearing member and the supply member are disposed, a developer containing chamber that contains the developer, a partition wall that partitions the developing chamber and the developer containing chamber from each other and is provided with an opening that communicates the developing chamber and the developer containing chamber with each other, and a conveyance member that conveys the developer from the developer containing chamber to the developing chamber. The conveyance member is provided with a hole through which the developer can pass or has a protrusion that generates a gap between the conveyance member and the partition wall.

16 Claims, 9 Drawing Sheets

DEVELOPING DEVICE, PROCESS CARTRIDGE, AND IMAGE FORMING APPARATUS

BACKGROUND OF THE INVENTION

Field of the Invention

The disclosure relates to an image forming apparatus that forms an image on a recording medium by using an electrophotographic process and more specifically to a developing device and a process cartridge that are applied to the image forming apparatus.

Description of the Related Art

An image forming apparatus, such as a printer, that employs an electrophtographic image forming process (electrophotographic process) first electrically charges an electrophotographic photosensitive member (hereinafter referred to as a photosensitive member), which serves as an image bearing member, uniformly. An electrostatic image is subsequently formed on the photosensitive member by selectively exposing the electrically charged photosensitive member to light. The electrostatic image formed on the photosensitive member is developed into a visible toner image by using toner as developer. The toner image formed on the photosensitive member is transferred onto a recording medium, such as a sheet of recording paper or a plastic sheet. The toner image transferred on the recording medium is subsequently fixed by applying heat and pressure. Image recording is thus performed.

Such an image forming apparatus normally requires supply of the developer and maintenance of various processing devices. It is normal practice to bring the photosensitive member, a charging device, a developing device, and a cleaning device together into a process cartridge in order to facilitate supply of the developer and maintenance of various processing devices. The process cartridge is formed so as to be detachably installed in the main body of the image forming apparatus. An image forming apparatus that is excellent in usability can be provided by adopting the process cartridge.

Meanwhile, a color image forming apparatus that forms a color image by using developers of multiple colors becomes popular in recent years. A color image forming apparatus that employs so-called an in-line process is known, Such a color image forming apparatus includes photosensitive members corresponding to respective image forming by using the developers of multiple colors. The photosensitive members are disposed in a row in a moving direction of the surface of a member to which the toner image is transferred. A type of color image forming apparatus employing the in-line process has multiple photosensitive members that are disposed in a row in a direction (for example, in a horizontal direction) intersecting the vertical direction (gravity direction), The in-line process is advantageous in that the image forming apparatus employing the in-line process can readily respond to a demand for speeding up of image forming operation or for improvement into a multifunction printer.

Another type of image forming apparatus that employs the in-line process, in which multiple photosensitive members are disposed in a row in a direction intersecting the vertical direction, is an image forming apparatus in which multiple photosensitive members are disposed under an intermediate transfer member or a recording medium hearing member for conveying a recording medium. The intermediate transfer member and the recording medium bearing member are members onto which an image is transferred.

In the case where the photosensitive members are disposed under the intermediate transfer member or the recording medium bearing member, developing devices (i.e., exposure units) can be disposed away from, for example, a fixing unit while the intermediate transfer member or the recording medium bearing member is interposed between the developing device and the fixing unit within the main body of the image forming apparatus. This is advantageous because the developing devices (or the exposure unit) are hardly affected by the heat of the fixing unit.

On the other hand, in the case where the photosensitive members are disposed under the intermediate transfer member or the recording medium bearing member, developer may need to be supplied against gravity from a developer containing section to a developer bearing member or to a supply member in the developing device. In addition, it may be necessary to establish a circulation of the developer from a developing chamber to a developer containing chamber that is disposed below the developing chamber in order to suppress deterioration of the developer within the developing chamber.

Japanese Patent Laid-Open No. 2016-105200 proposes a method of establishing a circulation in which the developer in the developing chamber is returned to the developer containing chamber via an opening that communicate the developing chamber and the developer containing chamber with each other. The developer is returned due to the developer bearing member and the supply member rotating in a direction in which the respective surfaces of the members move from the upper end of the nip portion (contact portion) to the lower end thereof.

A conveyance member that conveys the developer within the developer containing chamber may become long in a case where, for example, the developer containing chamber is made large in order to respond to a demand for a large capacity. When the conveyance member becomes long to such an extent as to cover part of the opening that communicate the developing chamber and the developer containing chamber with each other, a flow of developer returning from the developing chamber to the developer containing chamber may be hampered. As a result, the image density may decrease.

SUMMARY OF THE INVENTION

The disclosure provides a developing device that suppresses hampering of developer circulation even in the case where a conveyance member is made longer in a system in which developer is returned from a developing chamber to a developer containing chamber via an opening provided in a partition wall that partitions the developing chamber and the developer containing chamber from each other.

The disclosure provides a developing device that includes, a developer bearing member that bears the developer, a supply member that comes into contact with the developer bearing member and thereby supplies the developer to the developer bearing member, a developing chamber in which the developer bearing member and the supply member are disposed, a developer containing chamber that contains the developer and at least part of which is positioned at a level below the developing chamber, a partition wall that partitions the developing chamber and the developer containing chamber from each other and is provided with an opening, the opening communicates the developing chamber and the developer containing chamber with each other, a lower edge of the opening is positioned at a level below an upper end of a contact portion formed by the supply member and the developer bearing member, and a conveyance member that is rotatably disposed within the developer containing chamber and that conveys the developer from the developer containing chamber to the developing chamber via the opening and is provided with a hole through which the developer can pass. In the developing device, the developer bearing member and the supply member rotate in such a manner that movement directions of respective surfaces of the developer bearing member and the supply member at the contact portion include a downward component in a gravity direction. In addition, in a state where a leading edge of the conveyance member is positioned at a level above the upper end of the contact portion, a lower edge of the hole is positioned at a level below the upper end of the contact portion and an upper edge of the hole is positioned at a level above the lower edge of the opening.

Further features of the disclosure will become apparent from the following description of example embodiments with reference to the attached drawings.

DESCRIPTION OF THE EMBODIMENTS

Example embodiments of the invention will be described with reference to the drawings. Note that dimensions, materials, shapes, relative positions, or the like, of elements described in the embodiments below may be changed appropriately in accordance with configurations and various conditions of an apparatus to which the disclosure is applied, and accordingly, the embodiments described below should not be construed as limiting the scope of the invention.

In the present embodiment, rotation axes of image bearing members, rotation axes of developer bearing members, rotation axes of supply members, and rotation axes of conveyance members, which will be described later, are substantially parallel to each other unless otherwise specified. In addition, the longitudinal direction of each member is substantially the same as the direction of the rotation axis of the member.

In the present embodiment, the cross-sectional direction is a direction that intersects the direction of the rotation axis of any one of the members unless otherwise specified. Thus, the cross-sectional view is a view of an object that is cut in the cross-sectional direction and viewed in the rotation axis direction.

In the present embodiment, the up-and-down direction is a direction extending in the gravity direction unless otherwise specified. Note that the gravity direction is defined with respect to the position of an apparatus or a component to which the disclosure is applied when the apparatus or the component assumes a position in normal use.

First Example Embodiment

Examples of an image forming apparatus, a process cartridge, and a developing device according to the disclosure will be described with reference to the drawings. Note that the position of the apparatus in normal use is the position when the apparatus forms an image on a recording medium unless otherwise specified.

Example Electrophotographic Image Forming Apparatus

Figure 2:
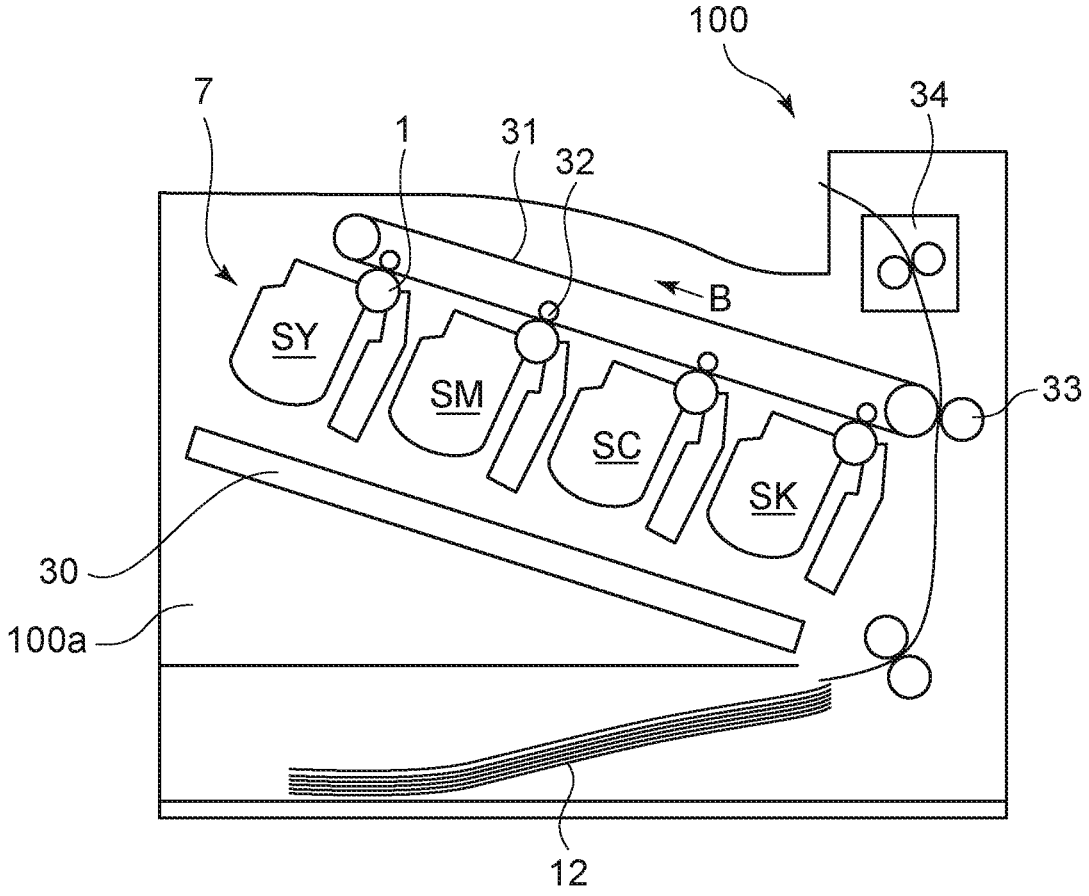
FIG. 2 is a cross-sectional view illustrating an image forming apparatus according to the example first embodiment.

An overall configuration of an embodiment of an electrophotographic image forming apparatus (image forming apparatus) will be described. FIG. 2 is a cross-sectional view illustrating an image forming apparatus 100 according to the present embodiment. The image forming apparatus 100 according to the present embodiment is a full-color laser printer that employs an in-line process and an intermediate transferring process. The image forming apparatus 100 is capable of forming a full-color image on a recording medium (e.g., a sheet of recording paper, a plastic sheet, a piece of cloth, etc.) in accordance with image information. The image information is input into the main body of the image forming apparatus from an image scanner that is connected to the main body or from a host device, such as a personal computer, that is capable of communicating with the main body. The image forming apparatus 100 includes multiple process cartridges 7. The multiple process cartridges 7 serve as image forming sections SY, SM, SC, and SK to form respective color images of yellow (Y), magenta (M), cyan (C), and black (K). In the present embodiment, the image forming sections SY, SM, SC, and SK are disposed in a row extending in a direction intersecting the vertical direction.

Each of the process cartridges 7 is detachably installed in an apparatus body 100*a* of the image forming apparatus 100 by using installation devices, such as an installation guide and a positioning member, that are disposed in the main body of the image forming apparatus. In the present embodiment, the process cartridges 7 for respective colors have the same shape and accommodate respective toners of yellow (Y), magenta (M), cyan (C), and black (K). Although the process cartridges are described as being detachable in the present embodiment, only developing devices 3 may be detachably installed into the main body of the image forming apparatus.

A photosensitive drum 1 is disposed to serve as an image bearing inember. The photosensitive drum 1 is rotationally driven by a drive unit (drive source) (not illustrated). A scanner unit (exposure unit) 30 is disposed near the photosensitive drum 1. The scanner unit 30 is an exposure unit that forms an electrostatic image (electrostatic latent image) on the photosensitive drum 1 by irradiating the photosensitive drum 1 with laser light according to the image information. An intermediate transfer belt 31 that serves an intermediate transfer member is disposed so as to oppose four photosensitive drums 1. The intermediate transfer belt 31 is provided for transferring toner images formed on the surfaces of the respective photosensitive drums 1 onto a recording medium 12.

The intermediate transfer belt 31 that serves as the intermediate transfer member is in contact with all of the photosensitive drums 1 and moves (i.e., rotates) in a circular manner in the direction of arrow B in FIG. 2 (counterclockwise). The intermediate transfer belt 31 is an endless belt in the circulation movement direction.

Four primary transfer rollers 32, which serve as primary transfer devices, are disposed in a row on the inner peripheral side of the intermediate transfer belt 31 so as to oppose the respective photosensitive drums 1. A voltage that has a polarity opposite to the normal charging polarity of toner (i.e., negative polarity in the present embodiment) is applied to each of the primary transfer rollers 32 by a primary transfer voltage source (high-voltage power supply) (not illustrated), which serves as a primary transfer voltage application device. The toner image on each of the photosensitive drums 1 is thereby transferred (primary-transferred) onto the intermediate transfer belt 31.

A secondary transfer roller 33, which serves as a secondary transfer device, is disposed on the outer peripheral side of the intermediate transfer belt 31. A voltage that has a polarity opposite to the normal charging polarity of toner is applied to the secondary transfer roller 33 by a secondary transfer voltage source (high-voltage power supply) (not illustrated), which serves as a secondary transfer voltage application device. The toner images on the intermediate transfer belt 31 are thereby transferred (secondary-transferred) onto a recording medium 12. When forming a full-color image, for example, a toner image of each color is primary-transferred consecutively on the intermediate transfer belt 31 at a corresponding one of the image forming sections SY, SM, SC, and SK in such a manner that toner images of different colors are overlaid on each other. Subsequently, a recording medium 12 is conveyed to the secondary transfer portion in synchronization with movement of the intermediate transfer belt 31. The toner images of four colors on the intermediate transfer belt 31 is secondary-transferred onto the recording medium 12 as a whole by operation of the secondary transfer roller 33 that is in contact with the intermediate transfer belt 31 with the recording medium 12 interposed therebetween.

The recording medium 12 onto which the toner image has been transferred is conveyed to a fixing unit 34, which serves as a fixing device. The recording medium 12 is subjected to heat and pressure at the fixing unit 34, and the toner image is thereby fixed on the recording medium 12.

The photosensitive drums 1 are disposed below the intermediate transfer belt 31. Each of the photosensitive drums 1 is exposed to light by an exposure unit 30 that is disposed at a position below the corresponding process cartridge 7.

Example Process Cartridge

An overall configuration of a process cartridge 7 that is installed in the image forming apparatus according to the present embodiment will be described.

Figure 1:
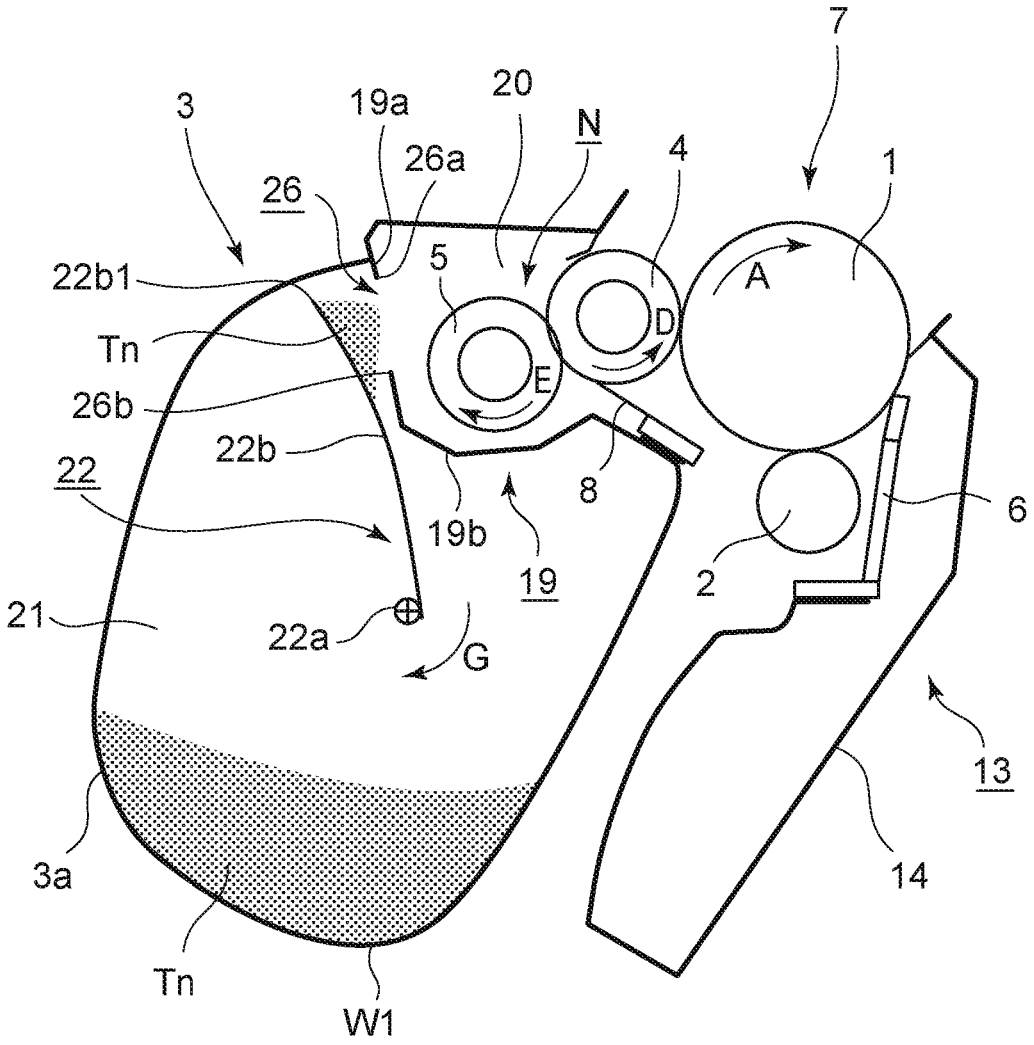
FIG. 1 is a cross-sectional view illustrating an example developing device and a process cartridge according to a first embodiment.

FIG. 1 is a cross-sectional view (principal section) of the process cartridge 7 according to the present embodiment when viewed in the longitudinal direction (rotation axis direction) of a photosensitive drum 1. Note that in the present embodiment, configurations and operation of the process cartridges 7 for respective colors are substantially the same except for the type (color) of developer accommodated therein.

In the present embodiment, each process cartridge 7 includes a photosensitive drum 1, which is a rotatable image bearing member. The photosensitive drum 1 bears an electrostatic latent image on the surface thereof. The process cartridge 7 includes a charging roller 2 that serves as a charging member for charging the surface of the photosensitive drum 1. The charging roller 2 is rotatable. The process cartridge 7 also includes a cleaning member 6 that serves as a cleaner for cleaning the surface of the photosensitive drum 1.

In the present embodiment, the process cartridge 7 includes a developing roller 4 that serves as a rotatable developer bearing member that bears toner as developer. The developing roller 4 develops the electrostatic latent image on the photosensitive drum 1 by supplying toner to the photosensitive drum 1. The process cartridge 7 includes a supply roller 5 that serves as a rotatable supply member that comes in contact with the developing roller 4 and thereby supplies toner to the developing roller 4, The process cartridge 7 includes a developing blade 8 that serves as a regulation member for regulating the thickness of the toner born by the developing roller 4.

In the present embodiment, the process cartridge 7 includes a photosensitive member unit 13 and a developing unit 3 that serves as a developing device.

The photosensitive member unit 13 includes the photosensitive drum 1, the charging roller 2, and the cleaning member 6. The photosensitive member unit 13 also includes a cleaning housing 14.

The developing unit 3 includes the developing roller 4, the supply roller 5, and the developing blade 8. The developing unit 3 also includes a developing housing 3*a*.

The developing unit 3 includes a developing chamber 20 that accommodates the developing roller 4 and the supply roller 5. A portion of the developing roller 4 is exposed to the outside of the developing chamber 20 (outside of the developing housing 3*a*) so as to supply toner to the photosensitive drum 1.

The developing unit 3 includes a toner containing chamber 21 that serves as a developer containing chamber for containing toner to be conveyed to the developing chamber 20. The developing unit 3 includes a partition wall 19 that partitions the developing chamber 20 from the toner containing chamber 21. A developing opening 26 is provided in the partition wall 19. The developing opening 26 serves as an opening that communicates the developing chamber 20 and the toner containing chamber 21 with each other. In other words, the developing housing 3*a* includes the partition wall 19, and the space inside the developing housing 3*a* is partitioned into the developing chamber 20 and the toner containing chamber 21 by the partition wall 19. The developing roller 4 is disposed in an upper portion of the developing unit 3 to supply toner to the photosensitive drum 1 that is disposed below the intermediate transfer belt 31.

In other words, the developing chamber 20 is disposed above the toner containing chamber 21. More specifically, at least a portion of the toner containing chamber 21 is located below the developing chamber 20. In other words, at least a portion of the toner containing chamber 21 is disposed directly under the developing chamber 20. The developing opening 26 is provided at a position above the rotation axis (rotation center of the rotation shaft 22*a*) of a toner conveyance member 22, which will be described later. At least the developing opening 26 and the developing roller 4 or at least the developing opening 26 and the supply roller 5 are disposed such that the respective positions in the gravity direction are substantially the same. In other words, the developing roller 4, the supply roller 5, and the developing opening 26 are disposed such that at least the developing opening 26 and the developing roller 4 or at least the developing opening 26 and the supply roller 5 overlap each other when viewed in a horizontal direction.

Example Photosensitive Member Unit

The photosensitive member unit 13 will be further described with reference to FIG. 1.

The photosensitive drum 1 is rotatably attached to the photosensitive member unit 13 via bearings (not illustrated). The photosensitive drum 1 receives a drive force from a drive motor (not illustrated) disposed in the apparatus body 100*a*. The photosensitive drum 1 is thereby rotated in the direction of arrow A (clockwise). In the present embodiment, the photosensitive drum 1 is an organic photosensitive drum formed of an aluminum cylinder coated with a carrier generation layer, a carrier transporting layer, and the like, on the peripheral surface thereof.

The charging roller 2 and the cleaning member 6 are disposed in the photosensitive member unit 13 so as to be in contact with the peripheral surface of the photosensitive drum 1. The cleaning member 6 removes residual toner from the surface of the photosensitive drum 1. The residual toner falls into the cleaning housing 14 and is accommodated therein.

The charging roller 2 has a metal core (electroconductive shaft) and a roller portion made of an electroconductive rubber. The charging roller 2 is pressed against the photosensitive drum 1 and is rotated passively while the roller portion is in contact with the photosensitive drum 1.

When forming an image, a predetermined direct current voltage suitable for the photosensitive drum 1 is applied to the metal core of the charging roller 2. A portion having a uniform potential Vd is thereby created on the surface of the photosensitive drum 1. The photosensitive drum 1 is subsequently exposed to laser light corresponding to image data. The laser light is emitted by the scanner unit 30, Carriers generated in the carrier generation layer in the exposed portion eliminate electric charges on the surface and lower the electric potential. As a result, the exposed portion becomes a portion having a predetermined potential Vl, and the unexposed portion becomes a portion having a predetermined potential Vd.

Here, the potential Vd is called "dark-area potential". The potential Vl is called "light-area potential". A portion having the dark-area potential on the surface of the photosensitive drum 1 is called a "dark-area potential portion". A portion having the light-area potential on the surface of the photosensitive drum 1 is called a "light-area potential portion", In the present embodiment, the light-area potential is approximately −100 V. The dark-area potential is approximately −500 V.

Thus, an electrostatic latent image is formed on the surface of the photosensitive drum 1.

Example Developing Unit

The developing unit 3 will be described further with reference to FIG. 1.

The developing unit 3 uses a nonmagnetic single-component toner. In the present embodiment, the toner is a polymerized toner. The average diameter of the toner is 7 to 8 μm. An amount of 1.5 wt % of hydrophobic silica as a fluidity imparting agent is added to toner particles. Toner is accommodated in the developing housing 3*a*.

The developing unit 3 has a developing roller 4 in the developing housing 3*a*. The developing roller 4 serves as a developer bearing member that bears toner. The developing roller 4 is formed of a metal core (electroconductive shaft) and an electroconductive elastic member disposed around the outer peripheral surface of the metal core in such a manner that the total diameter of the roller becomes 15 mm. The developing roller 4 receives a drive force from a drive motor (not illustrated) disposed in the apparatus body 100*a*. The developing roller 4 is thereby rotated in the direction of arrow D. The developing roller 4 and the photosensitive drum 1 rotate such that the respective surfaces move in the same direction (upward in the present embodiment) in the opposing region.

In the present embodiment, the developing roller 4 is disposed so as to be in contact with the photosensitive drum 1. However, the developing roller 4 may be disposed so as to be in proximity to the photosensitive drum 1 with a predetermined gap therebetween.

In the present embodiment, a predetermined direct current voltage (DC voltage) is applied to the developing roller 4. In the present embodiment, −300 V is applied to the developing roller 4. Toner charged to negative polarity by triboelectric charging is transferred only to the light-area potential portion due to the potential difference between the surface of the photosensitive drum 1 and the surface of the developing roller 4 at the developing portion where the developing roller 4 comes into contact with the photosensitive drum 1. The electrostatic latent image is thereby developed into a visible image.

The developing unit 3 has a toner supply roller (hereinafter simply referred to as "supply roller") 5. The supply roller 5 serves as a supply member that is in contact with the developing roller 4 and thereby supplies toner to the developing roller 4. The supply roller 5 rotates in the direction of arrow E. The supply roller 5 is disposed so as to form a predetermined contact portion (nip portion) N on the peripheral surface of the developing roller 4. The supply roller 5 is an elastic sponge roller formed of an electroconductive metal core and a foam layer disposed around the outer peripheral surface of the metal core in such a manner that the total diameter of the roller becomes 15 mm. The foam layer is made of open-cell foam in which foam cells are interconnected. The surface made of the open-cell foam can takes a large amount of toner in the supply roller 5. The cell diameter at the surface of the supply roller 5 ranges from 100 to 400 μm.

The developing blade 8 is disposed in the developing unit 3, The developing blade 8 regulates the coating amount of toner on the developing roller 4 that has been supplied from the supply roller 5. The developing blade 8 also imparts electric charge to the toner. The developing blade 8 is a thin plate-like member. The developing blade 8 presses toner and the developing roller 4 due to the elasticity of the plate-like member. Toner is charged triboelectrically due to sliding of the developing blade 8 on the developing roller 4. The thickness of the toner layer on the surface of the developing roller 4 is simultaneously regulated. In the present embodiment, the toner coat (toner that covers the developing roller 4) is also stabilized by applying a predetermined voltage to the developing blade 8 from a blade voltage power supply (not illustrated).

The toner containing chamber 21 that contains toner is disposed at a position into which the toner removed from the developing roller 4 by the developing blade 8 falls.

Moreover, the toner conveyance member 22, which serves as a conveyance member, is disposed in the toner containing chamber 21. The toner conveyance member 22 can rotate in the direction of arrow G in FIG. 1, The toner conveyance member 22 churns toner Tn accommodated in the toner containing chamber 21 and conveys toner Tn to a region above the supply roller 5.

The toner conveyance member 22 according to the present embodiment will be described further below. The toner conveyance member 22 has the rotation shaft 22*a* and a conveyance sheet 22*b* that serves as a conveyance portion. The conveyance sheet 22*b* is fixed to the rotation shaft 22*a*. The conveyance sheet 22*b* is fixed to the rotation shaft 22*a* in substantially all the length in the rotation axis direction (longitudinal direction) of the rotation shaft 22*a*, The conveyance sheet 22*b* is made of, for example, a flexible resin sheet, such as a polyester film or a polycarbonate film, having a thickness of 50 to 250 μm. The conveyance sheet 22*b* is a rectangular sheet member. The downstream side of the conveyance sheet 22*b* in the rotation direction is referred to as the toner conveyance surface of the conveyance sheet 22*b* or the toner conveyance surface of the toner conveyance member 22.

The toner conveyance member 22 and the rotation shaft 22*a* share the same rotation axis (rotation center). The leading edge of the toner conveyance member 22 is the distal edge of the conveyance sheet 22*b* in the rotation-radius direction (direction orthogonally intersecting the rotation axis) of the toner conveyance member 22.

The toner conveyance member 22 conveys toner from the toner containing chamber 21 to the developing chamber 20 via the developing opening 26. The conveyance sheet 22*b* is an elastic member having flexibility. The leading edge 22*b*1 of the toner conveyance member 22 (i.e., leading edge 22*b*1 of the conveyance sheet 22*b*) is brought into contact with the interior wall of the toner containing chamber 21 and is thereby deformed. This is elastic deformation. When the conveyance sheet 22*b* recovers from the deformation, the conveyance sheet 22*b* throws toner up toward the developing opening 26.

Example Supply Roller and Developing Roller

The supply roller 5 and the developing roller 4 will be described with reference to FIG. 1 and FIG. 3.

Figure 3:
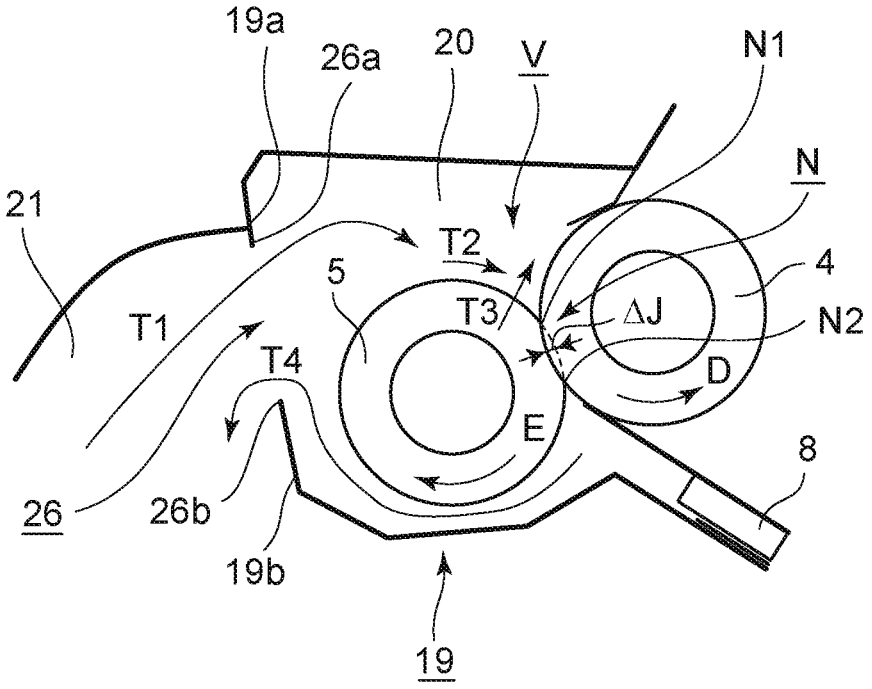
FIG. 3 is a cross-sectional view illustrating movement of toner in the developing device according to the first embodiment.

The supply roller 5 is disposed so as to form a contact portion N on the peripheral surface of the developing roller 4, As illustrated in FIG. 3, the supply roller 5 and the developing roller 4 are brought into contact with each other in such a manner that the developing roller 4 depresses the supply roller 5. Here, the depressed amount ΔJ of the supply roller 5 is referred to as "inroad amount". In the present embodiment, the inroad amount of the supply roller 5 caused by the developing roller 4, in other words, the depressed amount ΔJ of the supply roller 5 that is depressed by the developing roller 4, is 1 millimeter.

The supply roller 5 rotates in the direction of arrow E in FIG. 1 such that the respective surfaces of the supply roller 5 and the developing roller 4 move in the same direction at the contact portion N therebetween. In the present embodiment, the developing roller 4 rotates at 100 rpm, while the supply roller 5 rotates at 200 rpm. In other words, the surface velocity of the developing roller 4 is approximately 80 mm/sec. The surface velocity of the supply roller 5 is approximately 160 mm/sec.

The supply roller 5 and the developing roller 4 will be described further in detail. In the contact portion N, both of the moving directions of the respective surfaces of the supply roller 5 and the developing roller 4 include a downward component in the gravity direction. In other words, in the contact portion N between the supply roller 5 and the developing roller 4, the supply roller 5 is in contact with the developing roller 4 in such a manner that the respective surfaces of the supply roller 5 and the developing roller 4 move in a direction that includes a downward component in the gravity direction. Still in other words, when a contact portion upper end N1 denotes the upper one of the ends (upper end) of the contact portion N and a contact portion lower end N2 denotes the lower one of the ends (lower end) of the contact portion N, the developing roller 4 and the supply roller 5 rotate in a direction in which the respective surfaces move from the contact portion upper end N1 to the contact portion lower end N2.

Here, the mechanism with which the supply roller 5 coats the surface of the developing roller 4 with toner will be described with reference to FIG. 3. FIG. 3 is a cross-sectional view illustrating movement of toner in the developing device. In FIG. 3, movement of toner that has been conveyed to the toner supply member 5 by the toner conveyance member 22 is illustrated.

When toner is supplied to the developing chamber 20 by the toner conveyance member 22, the toner is supplied mainly toward a region above the supply roller 5 (arrow T1 in FIG. 3). The toner supplied to the region above the supply roller 5 stays on the surface of the supply roller 5 and in the inside thereof. Rotation of the supply roller 5 in the direction of arrow E conveys the toner to the contact portion N between the supply roller 5 and the developing roller 4 (arrow T2 in FIG. 3). The supply roller 5 deforms immediately in front of the contact portion N between the supply roller 5 and the developing roller 4. Due to this deformation, a portion of the toner staying on the surface and in the inside of the supply roller 5 (arrow T3 in FIG. 3) is discharged from the supply roller 5. The discharged toner stays temporarily in a space (hereinafter referred to as a "temporary toner reservoir V") above the developing roller 4 and the supply roller 5.

The toner subsequently enters the contact portion N, and sliding contact between the developing roller 4 and the supply roller 5 imparts electric charge to the toner. After the toner passes through the contact portion N, the electrically charged toner is electrostatically adsorbed to the developing roller 4 due to the amount of charge of the toner. Due to this effect, toner is supplied from the supply roller 5 to the developing roller 4. A portion of the toner supplied onto the developing roller 4 is removed by the regulation member 8, and a toner coat having a desired thickness is thereby formed on the developing roller 4. A portion of the toner including the toner removed by the regulation member 8 is conveyed by rotation of the supply roller 5 toward the developing opening 26 formed in the developing chamber 20. The toner is consequently returned through the developing opening 26 to the toner containing chamber 21 (arrow T4 in FIG. 3).

The partition wall 19, which separates the developing chamber 20 and the toner containing chamber 21 from each other, includes a lower wall 19*b* that is a wall extending downward from the developing opening 26. An opening lower edge 26*b* denotes the upper edge (top edge) of the lower wall 19*b*, in other words, the lower edge (bottom edge) of the developing opening 26. The partition wall 19 also includes an upper wall 19*a* that is a wall extending upward from the developing opening 26. An opening upper edge 26*a* denotes the lower edge (bottom edge) of the upper wall 19*a*, in other words, the upper edge (top edge) of the developing opening 26.

The opening lower edge 26*b* is positioned at a level one millimeter lower than the center of the supply roller 5 (i.e., the rotation axis of the supply roller 5). In addition, the opening lower edge 26*b* is disposed at a level below the contact portion upper end N1. In the present embodiment, the opening lower edge 26*b* is positioned at a level below the contact portion lower end N2.

The supply roller 5 is disposed in such a manner that the maximum gap between the bottom wall of the developing chamber 20 (a portion of the lower wall 19*b*) and the bottom surface of the supply roller 5 is 1.5 mm.

As described above, when toner is supplied to the supply roller 5, the toner is first supplied via the developing opening 26 to the temporary toner reservoir V by the toner conveyance member 22. On the other hand, toner to be returned from the developing chamber 20 to the toner containing chamber 21 due to rotation of the supply roller 5 also passes through the developing opening 26. Accordingly, the configuration of the developing opening 26 affects a toner flow T4 from the developing chamber 20 to the toner containing chamber 21.

Image Density Decrease

Figure 4:
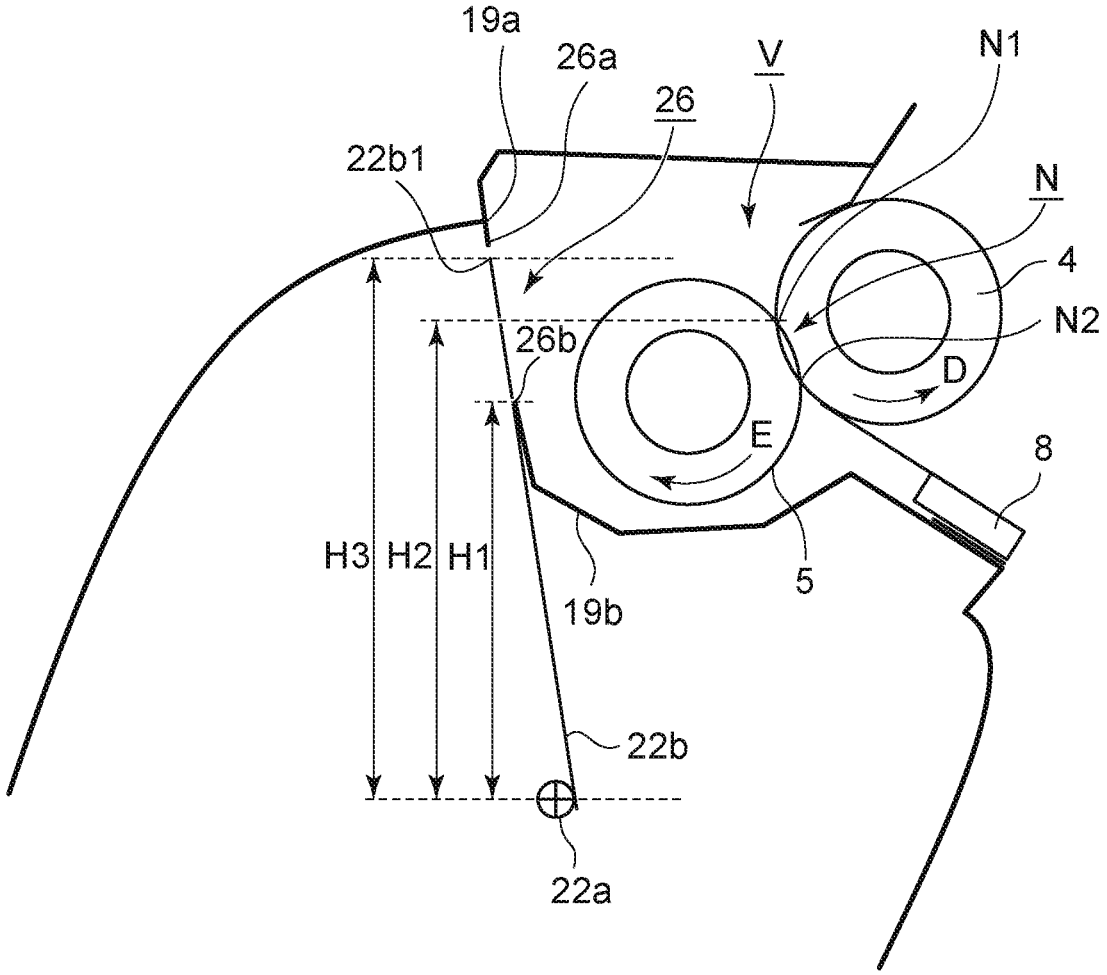
FIG. 4 is an enlarged cross-sectional view schematically illustrating a developing chamber and a portion of a toner containing chamber according to the first embodiment.

A phenomenon in which the density of a printed image becomes lower than a desired density is referred to as image density decrease. When high-density printing (i.e., printing consuming a large amount of developer) is continuously performed, the image density may decrease. Such a case will be described with reference to FIG. 3 and FIG. 4. FIG. 4 is an enlarged cross-sectional view schematically illustrating a developing chamber 20 and a portion of a toner containing chamber 21. FIG. 4 illustrates a positional relationship, in the gravity direction, of the rotation center of the rotation shaft 22*a* (rotation axis of the conveyance member 22), the opening lower edge 26*b*, the leading edge 22*b*1 of the conveyance sheet 22*b*, and the contact portion N.

In FIG. 4, H1 denotes the height from the rotation center of the rotation shaft 22*a* to the upper edge of the lower wall 19*b*, in other words, to the opening lower edge 26*b*. H2 denotes the height from the rotation center of the rotation shaft 22*a* to the upstream end of the contact portion N in the rotation direction (i.e., the contact portion upper end N1). H3 denotes the height from the rotation center of the rotation shaft 22*a* to the leading edge of the conveyance sheet 22*b* when the conveyance sheet 22*b* comes into contact with the partition wall 19 near the developing opening 26.

The image density may decrease in two cases.

The first case is that a sufficient amount of toner is not present in the temporary toner reservoir V. In this case, the amount of toner that enters the contact portion N due to rotation of the developing roller 4 and the supply roller 5 is insufficient. As a result, the developing roller 4 cannot obtain a sufficient amount of toner for performing high-density printing, thereby leading to the image density decrease. This tends to occur especially when the amount of toner within the toner containing chamber 21 is small. The amount of toner that the toner conveyance member 22 throws toward the developing chamber 20 thereby becomes small.

The second case is that the height of toner near the developing opening 26 within the developing chamber 20 becomes higher than the level of the contact portion upper end N1.

In order to avoid the image density decrease, the toner accumulating above the contact portion N between the developing roller 4 and the supply roller 5 needs to enter the contact portion N. The toner accumulating above the contact portion N can enter the contact portion N smoothly when the height of the toner near the developing opening 26 is lower than the level of the contact portion upper end N1.

When the height of the toner near the developing opening 26 becomes higher than the level of the contact portion upper end N1, the toner near the developing opening 26 hampers the toner flow T4 caused by rotation of the supply roller 5 from the developing chamber 20 to the toner containing chamber 21 as described above. Toner consequently stays below the contact portion N between the developing roller 4 and the supply roller 5, which hampers supply of toner from the temporary toner reservoir V to the contact portion N. As a result, the amount of toner on the developing roller 4 becomes insufficient, which leads to the image density decrease.

The height of the toner near the developing opening 26 in the developing chamber 20 is normally determined by the height of the upper edge of the lower wall 19*b* (i.e., the opening lower edge 26*b*), In other words, the height of the toner is determined by a height relation between H1 and H2. Thus, when H1<H2, the image density decrease can be prevented.

On the other hand, the conveyance sheet 22*b* periodically comes close to the developing opening 26 in rotation of the rotation shaft 22*a* of the toner conveyance member 22. In this case, the height of the leading edge 22*b*1, which is the distal edge of the conveyance sheet 22*b* in the rotation-radius direction, may determine the height of the toner near the developing opening 26 in the developing chamber 20. This occurs when the leading edge 22*b*1 comes to a position higher than the upper edge of the lower wall 19*b* (i.e., the opening lower edge 26*b*).

As illustrated in FIG. 4, when the toner conveyance member 22 rotates and the height relation between H2 and H3 becomes H3>H2, the image density may decrease.

Example Toner Conveyance Member

Figure 5:
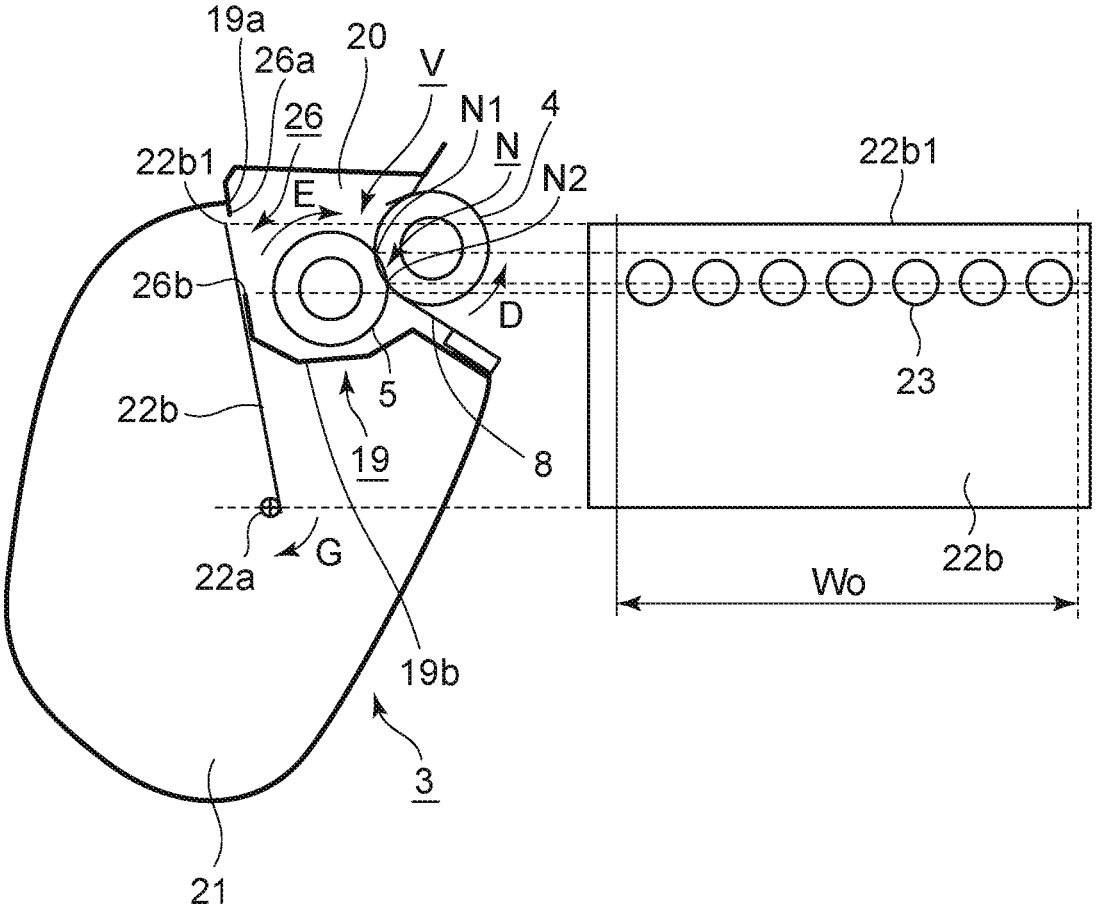
FIG. 5 is a view illustrating the developing device and a conveyance sheet according to the first embodiment.

The toner conveyance member 22 according to the present embodiment will be described further in detail with reference to FIG. 4 and FIG. 5. FIG. 5 is a view illustrating the developing device and the conveyance sheet according to the present embodiment. The view on the left-hand side in FIG. 5 is a cross-sectional view of the developing device according to the present embodiment. The view on the right-hand side in FIG. 5 is a view in which the conveyance sheet 22*b* on the left-hand side is projected in a horizontal direction.

The length of the conveyance sheet 22*b* in a natural state in the rotation-radius direction from the rotation shaft 22*a* is longer than the distance between the rotation center of the rotation shaft 22*a* and a wall surface W1 of the toner containing chamber 21 in the same rotation-radius direction. In other words, in a direction orthogonally intersecting the rotation axis of the toner conveyance member 22, the distance between the rotation axis and the leading edge of the toner conveyance member 22 that is in a natural state is longer than the distance between the rotation axis of the toner conveyance member 22 and the wall surface W1 of the toner containing chamber 21. Note that the wall surface W1 of the toner containing chamber 21 is a portion of the wall surface of the toner containing chamber 21 that is located below the level of the rotation axis of the toner conveyance member 22. The natural state is a state where the conveyance sheet 22*b* is not subjected to deformation.

The toner conveyance member 22 described above can supply toner efficiently even when the amount of toner in the toner containing chamber is small. This leads to a solution of the first case of image density decrease.

When the capacity of the toner containing chamber 21 is large, the conveyance sheet 22*b* needs to be long since the distance between the rotation center of the rotation shaft 22*a* and the wall surface W1 becomes large. In addition, in the state where the conveyance sheet 22*b* comes closest to the partition wall 19, the leading edge 22*b*1 of the conveyance sheet 22*b* is positioned above the level of the contact portion upper end N1. The conveyance sheet 22*b* can thereby supply toner reliably through the developing opening 26 to the region above the supply member 5, Note that in the present embodiment, the state where the conveyance sheet 22*b* comes closest to the partition wall 19 means that the conveyance sheet 22*b* is in contact with the partition wall 19.

In other words, in the present embodiment, the conveyance sheet 22*b* of the toner conveyance member 22 can come into contact with the partition wall 19 in the state where the leading edge 22*b*1 of the toner conveyance member 22 is positioned above the level of the contact portion upper end N1. With this configuration, toner can be reliably supplied through the developing opening 26 to the region above the supply member 5.

However, when the toner conveyance member 22 configured as such is used, the second case of image density decrease as described above may occur during the state indicated in FIG. 4 where H3>H2.

This phenomenon tends to occur especially when the amount of toner within the toner containing chamber 21 is large. This is because the amount of toner conveyed to the developing chamber 20 by rotation of the toner conveyance member 22 increases, which tends to increase the amount of toner in the developing chamber 20 and thereby increase the height of the toner near the developing opening 26.

In other words, in order to prevent the image density decrease in the configuration according to the present embodiment, it is necessary to maintain the amount of toner staying in the temporary toner reservoir V to a necessary level or more and, at the same time, to maintain the height of the toner near the developing opening 26 to H2 or less (i.e., to the level of the contact portion upper end N1 or lower).

In the present embodiment, as illustrated in FIG. 5, communication holes 23 (i.e., holes 23) are provided in part of the conveyance sheet 22*b* so as to penetrate the conveyance sheet 22*b* in order to lower the height of the toner. The conveyance sheet 22*b* according to the present embodiment has the communication holes 23 at positions corresponding to the developing opening 26 (positions overlapping the developing opening 26) in the rotation direction of the conveyance member 22 when the conveyance sheet 22*b* is in proximity to the developing opening 26. Note that reference Wo in the right-hand side view in FIG. 5 denotes the width of the developing opening 26. The communication holes 23 are provided such that the positions of the communication holes 23 overlap the position of the developing opening 26 in the rotation axis direction of the toner conveyance member 22.

In other words, the communication holes 23 are provided at a plurality of positions arranged in the rotation axis direction of the toner conveyance member 22. The communication holes 23 are provided with substantially the same spacing between adjacent holes in the rotation axis direction of the rotation shaft 22*a*. For example, the diameter of each communication hole 23 is set at 10 mm, and the spacing between adjacent communication holes 23 is set at 5 mm.

The toner near the developing opening 26 in the developing chamber 20 can thereby pass through the communication holes 23 and move to the toner containing chamber 21 even when the conveyance sheet 22*b* comes close to the developing opening 26. This can lower the height of the toner near the developing opening 26. In other words, the height of the toner near the developing opening 26 in the developing chamber 20 can be maintained to a level below the upstream end, in the rotation direction, of the contact portion between the supply roller 5 and the developing roller 4 (i.e., the contact portion upper end N1) at any timing in the rotational period of the toner conveyance member 22. Accordingly, the toner flow T4 in the developing opening 26 is not hampered anymore. This can prevent the image density decrease caused by the face that toner supply from the temporary toner reservoir V to the contact portion N is hampered.

The positions of the communication holes 23 in the state where the leading edge 22*b*1 of the toner conveyance member 22 is above the level of the contact portion upper end N1 will be described further in detail. Note that in the present embodiment, this is the state where the toner conveyance member 22 is in contact with the partition wall 19 and the toner in the developing chamber 20 can move through the communication holes 23 to the toner containing chamber 21.

In the above state, the lower edges of the communication holes 23 are positioned at a level below the contact portion upper end N1. This suppresses accumulation of toner near the developing opening 26 to a level above the contact portion upper end N1. In addition, the upper edges of the communication holes 23 are positioned at a level above the opening lower edge 26*b*. Toner can be thereby returned from the developing opening 26 to the toner containing chamber 21 through the communication holes 23. Moreover, in the present embodiment, the lower edges of the communication holes 23 are positioned at a level below the opening lower edge 26*b*. The toner that exceeds the level of the opening lower edge 26*b* can thereby pass through the communication holes 23 readily. As a result, the height of the toner can be effectively prevented from increasing.

Moreover, in the present embodiment, the upper edges of the communication holes 23 are positioned at a level below the contact portion upper end N1. This can suppress a reduction in the amount of toner that the toner conveyance member 22 conveys. In other words, this can maintain, to a desired level or more, the amount of toner that the leading edge of the conveyance sheet 22*b* conveys to the temporary toner reservoir V. As a result, the image density decrease due to the amount of toner being insufficient in the temporary toner reservoir V can be prevented.

[Experiments]

The following experiments were conducted with the configurations of the embodiments.

Image Density Evaluation

The amount of image density decrease was measured to study toner supply performance when high-density printing was continuously performed.

After the image forming apparatus was left for one day in an evaluation environment of 25.5° C. and 50% RH, the image forming apparatus performed printing on 100 sheets of A4 paper. The image forming apparatus printed an image consisting of horizontal lines on 100 sheets continuously. The ratio of the area covered by the image to the total area of a sheet was 5%. Subsequently, the entire image forming region on the photosensitive drum 1 was exposed to light to obtain an image covering the entire region of sheet except for margins. This image was output on three sheets consecutively. In the present embodiment, this image is referred to as a solid image. The solid image on the third sheet was measured for the density difference from the leading edge to the trailing edge of the sheet by using SPECTRODENSITOMETER500 available from X-Rite. Note that the image that was output for evaluation was a monochrome image.

Evaluation was conducted for three cases of toner amount, in other words, 50 g, 200 g, and 400 g, that remained in the toner containing chamber.

Evaluation results were classified into three groups as follows.

A: the density difference of the solid image from the leading edge to the trailing edge of the sheet is less than 0.2;

B: the density difference of the solid image from the leading edge to the trailing edge of the sheet is 0.2 or more and less than 0.3;

C: the density difference of the solid image from the leading edge to the trailing edge of the sheet is 0.3 or more.

The same experiment was conducted on the comparative examples below for comparison of effects.

Comparative Example 1

The configuration of Comparative Example 1 was such that the conveyance sheet did not have the communication holes 23 on the basis of the configuration of the first embodiment. Features other than the conveyance sheet were the same as those in the first embodiment.

Comparative Example 2

In Comparative Example 2, the height H3 from the rotation center of the rotation shaft 22*a* to the leading edge of the conveyance sheet 22*b* was lower than the height H2 from the rotation center of the rotation shaft 22*a* to the contact portion upper end N1 (i.e., H3<H2).

The evaluation results are collated in Table 1.

TABLE 1

| Toner amount in toner containing chamber | First embodiment | Comparative example 1 | Comparative example 2 |
|---|---|---|---|
| 50 g | A | A | C |
| 200 g | A | B | A |
| 400 g | A | C | A |

In the configuration of Comparative Example 1, the height of the toner near the developing opening 26 exceeded H2 and the image density decreased when the amount of toner in the toner containing chamber 21 was large and accordingly the amount of toner supplied by the toner conveyance member 22 was large.

In the configuration of Comparative Example 2, the image density decrease due to the height of the toner near the developing opening 26 exceeding H2 did not occur. However, toner conveyed to the temporary toner reservoir V became insufficient and the image density decreased when the toner amount in the toner containing chamber 21 was small.

On the other hand, in the configuration of the present embodiment, the height of the toner near the developing opening 26 was able to be suppressed to H2 or less due to provision of the communication holes 23 while a sufficient amount of toner was conveyed to the temporary toner reservoir V. This can prevent the image density decrease irrespective of the amount of toner remaining in the toner containing chamber 21.

Note that in the present embodiment, the communication holes 23 are provided, with an appropriate spacing therebetween, at a plurality of positions arranged in the rotation axis direction of the toner conveyance member 22. The toner conveyance member 22 may have an enlarged communication hole 23 that is enlarged in the rotation axis direction of the toner conveyance member 22.

Figure 9:
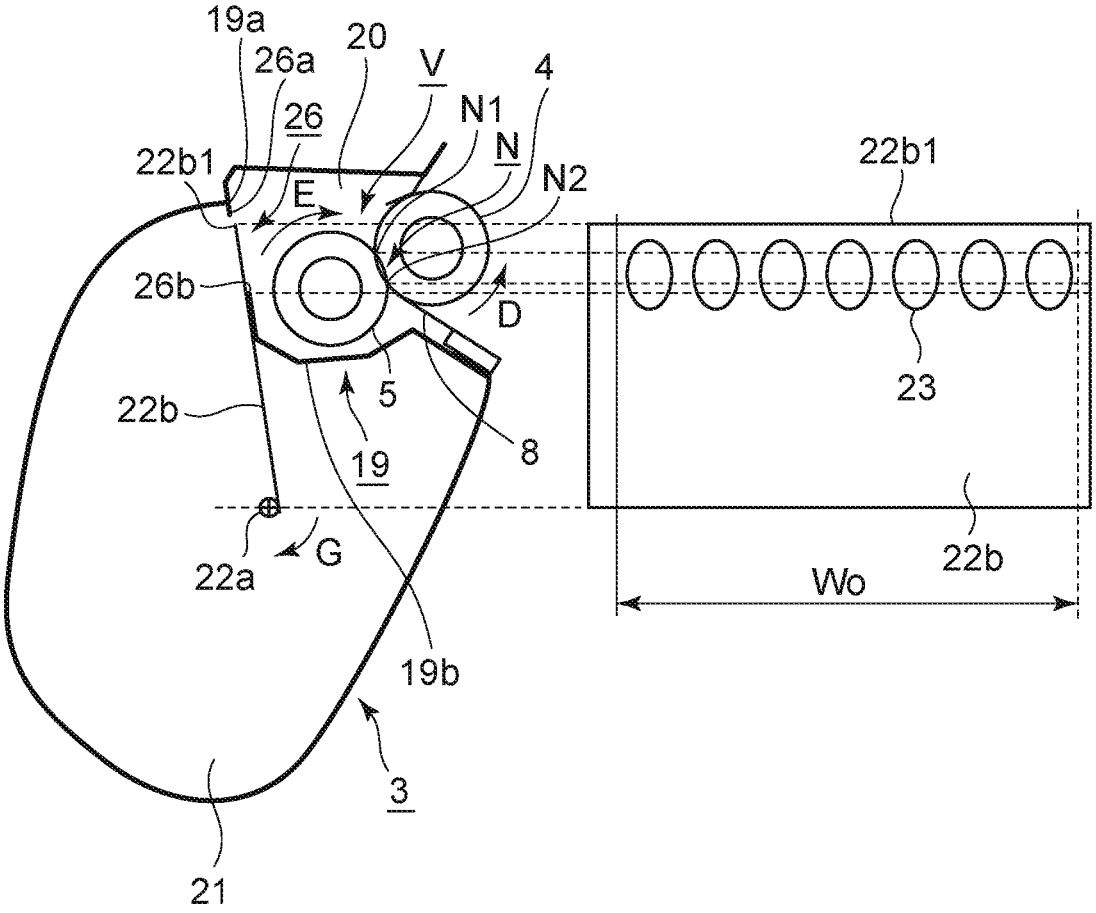
FIG. 9 is a view illustrating a configuration in which communication holes of the conveyance sheet according to the first embodiment are enlarged.

In addition, as illustrated in FIG. 9, the upper edges of the communication holes 23 may be positioned at a level above the contact portion upper end N1. Note that FIG. 9 is a view illustrating a configuration in which the communication holes of the conveyance sheet according to the first embodiment are enlarged.

Second Example Embodiment

Next, other example embodiments will be described. Note that the basic configurations and operation of a developing device, a process cartridge, or an image forming apparatus according to the present embodiment are the same as those of the first embodiment. In the description of the second embodiment, the same reference symbol is given to an element similar to that of the first embodiment, and duplicated description is thereby omitted.

In the image forming apparatus according to the second embodiment, the conveyance sheet 22*b* includes protrusions 24 that are formed on the surface thereof (i.e., the toner conveyance surface) that comes into contact with the partition wall 19.

Figure 6:
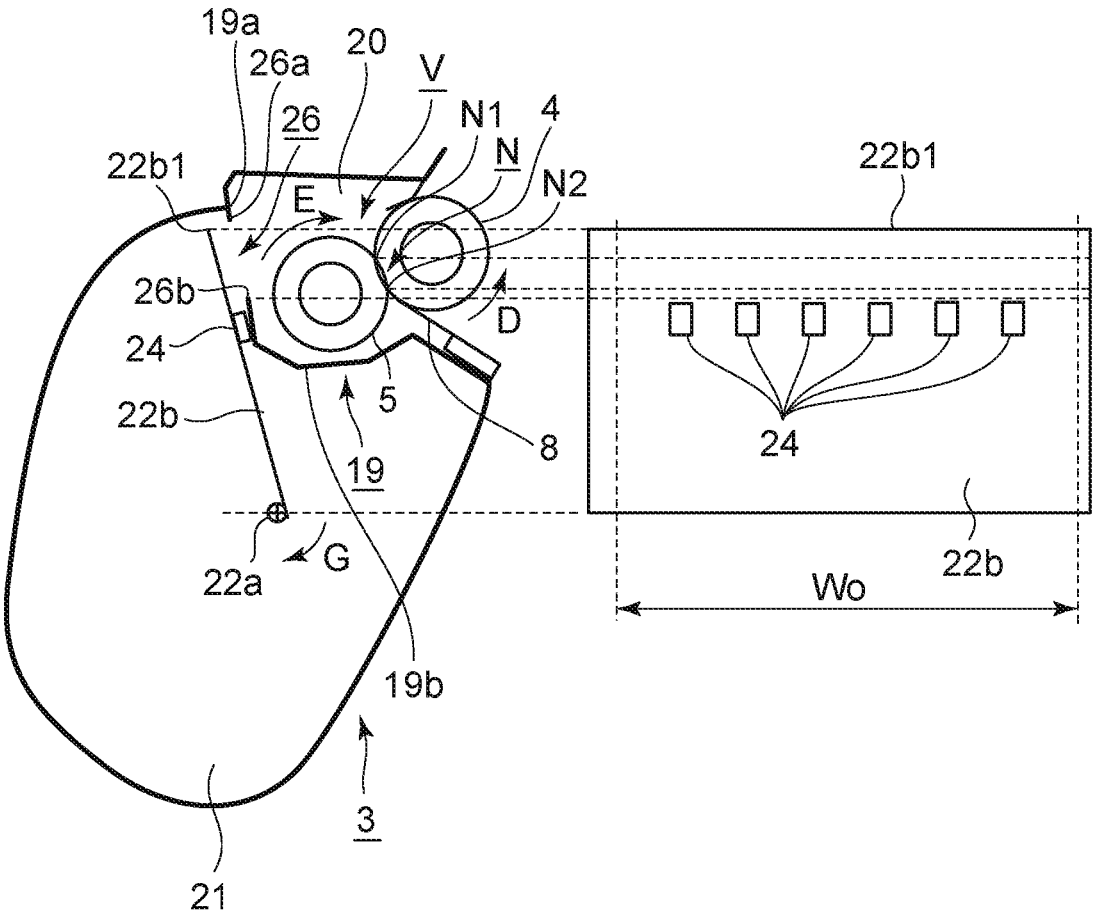
FIG. 6 is a view illustrating a developing device and a conveyance sheet according to an example second embodiment.

The developing device according to the present embodiment will be described with reference to FIG. 6. FIG. 6 is a view illustrating the developing device and the conveyance sheet according to the present embodiment. As illustrated in FIG. 6, the protrusions 24 are disposed on the toner conveyance surface of the conveyance sheet 22*b*. The view on the left-hand side in FIG. 6 is a cross-sectional view of the developing device according to the present embodiment. The view on the right-hand side in FIG. 6 is a view in which the conveyance sheet 22*b* on the left-hand side is projected in a horizontal direction.

In the present embodiment, the relation of the heights, from the rotation center of the rotation shaft 22*a*, of the opening lower edge 26*b*, of the contact portion upper end N1, and of the leading edge 22*b*1 when the conveyance sheet 22*b* comes into contact with the partition wall 19 (i.e., when the protrusions 24 come into contact with the partition wall 19) is the same as that in the first embodiment as indicated in FIG. 4.

In the present embodiment, the protrusions 24 are formed by adhering 2 mm thick polyester films to the toner conveyance surface of the conveyance sheet 22*b*. In addition, the protrusions 24 are disposed so as to come into contact with the lower wall 19*b* under the developing opening 26 when the toner conveyance member 22 is in proximity to the developing opening 26 in the rotation period thereof.

The protrusions 24 are disposed at a plurality of positions arranged in the rotation axis direction of the toner conveyance member 22. For example, the width of each protrusion 24 is set at 5 mm, and the spacing between adjacent protrusions 24 is set at 10 mm. Reference Wo in the right-hand side view in FIG. 6 denotes the width of the developing opening 26. The positions of the protrusions 24 in the rotation axis direction of the toner conveyance member 22 overlap the position of the developing opening 26.

In the present embodiment, the protrusions 24 are able to come into contact with the partition wall 19 while the leading edge of the toner conveyance member 22 is located above the level of the contact portion upper end N1. In other words, the toner conveyance member 22 according to the present embodiment has such a length that the leading edge of the toner conveyance member 22 is located above the level of the contact portion upper end N1 in the state where the protrusions 24 come into contact with the partition wall 19.

In the state where the protrusions 24 come into contact with the partition wall 19, a gap is created under the developing opening 26 between the conveyance sheet 22*b* of the toner conveyance member 22 and the partition wall 19.

By disposing the protrusions 24 in such a manner, the height of the toner near the developing opening 26 in the developing chamber 20 is determined by the height of the lower wall under the developing opening 26 at any timing in the rotational period of the toner conveyance member 22. As a result, the flow of toner within the developing chamber 20 is not hampered, and the image density decrease can be prevented.

The image density evaluation described in the first embodiment was also conducted for the present embodiment. The evaluation results are collated in Table 2.

The configuration of the second embodiment was such that the toner conveyance member 22 had the protrusions 24 on the basis of the configuration of Comparative Example 1,

TABLE 2

| Toner amount in toner containing chamber | Second embodiment |
|---|---|
| 50 g | A |
| 200 g | A |
| 400 g | A |

As indicated in Table 2, with the configuration of the present embodiment, the image density decrease was also prevented irrespective of the amount of toner remaining in the toner containing chamber 21 as is the case for the first embodiment. This is because due to the effect of the protrusions 24 disposed in the conveyance sheet 22*b*, the flow of toner within the developing chamber 20 is not hampered at any timing of the rotational period of the toner conveyance member 22.

In the present embodiment, the protrusions 24 are formed by adhering the polyester films to the toner conveyance surface of the conveyance sheet 22*b*. However, the protrusions 24 are not limited to this configuration. The protrusions 24 may be formed by using a different material. Alternatively, part of the conveyance sheet 22*b* may be formed so as to have shapes of the protrusions 24. For example, the shapes of the protrusions 24 may be integrally formed in the conveyance sheet 22*b* by using vacuum forming or the like.

Third Example Embodiment

Next, another embodiment will be described. Note that the basic configurations and operation of a developing device, a process cartridge, or an image forming apparatus according to the present embodiment are the same as those of the first embodiment. In the description of the third embodiment, the same reference symbol is given to an element similar to that of the first embodiment, and duplicated description is thereby omitted.

In the image forming apparatus according to the third embodiment, protrusions 25 are disposed on the lower wall 19*b* that is located downstream of the developing opening 26 in the direction of rotation of the rotation shaft 22*a* of the conveyance sheet 22*b*. The protrusions 25 protrude from the lower wall 19*b* toward the inside of the toner containing chamber 21.

In the present embodiment, the relation of the heights, from the rotation center of the rotation shaft 22*a*, of the opening lower edge 26*b*, of the contact portion upper end N1, and of the leading edge 22*b*1 when the conveyance sheet 22*b* comes into contact with the partition wall 19 (i.e., when the conveyance sheet 22*b* comes into contact with the protrusions 25) is the same as that in the first embodiment as indicated in FIG. 4.

Rotation of the rotation shaft 22*a* causes the conveyance sheet 22*b* to slide on the protrusions 25 and move in the rotation direction of the rotation shaft 22*a* without coming into contact with the opening lower edge 26*b* in part of the rotational period of the rotation shaft 22*a*.

Figure 7:
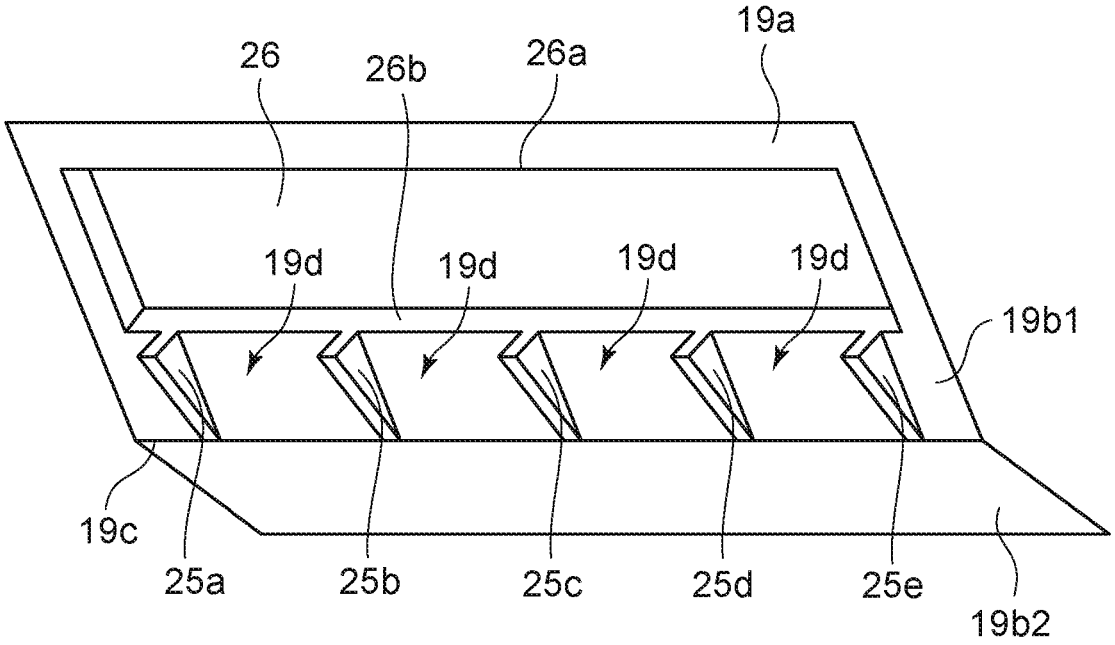
FIG. 7 is a perspective view illustrating the vicinity of a developing opening according to an example third embodiment.
Figure 8:
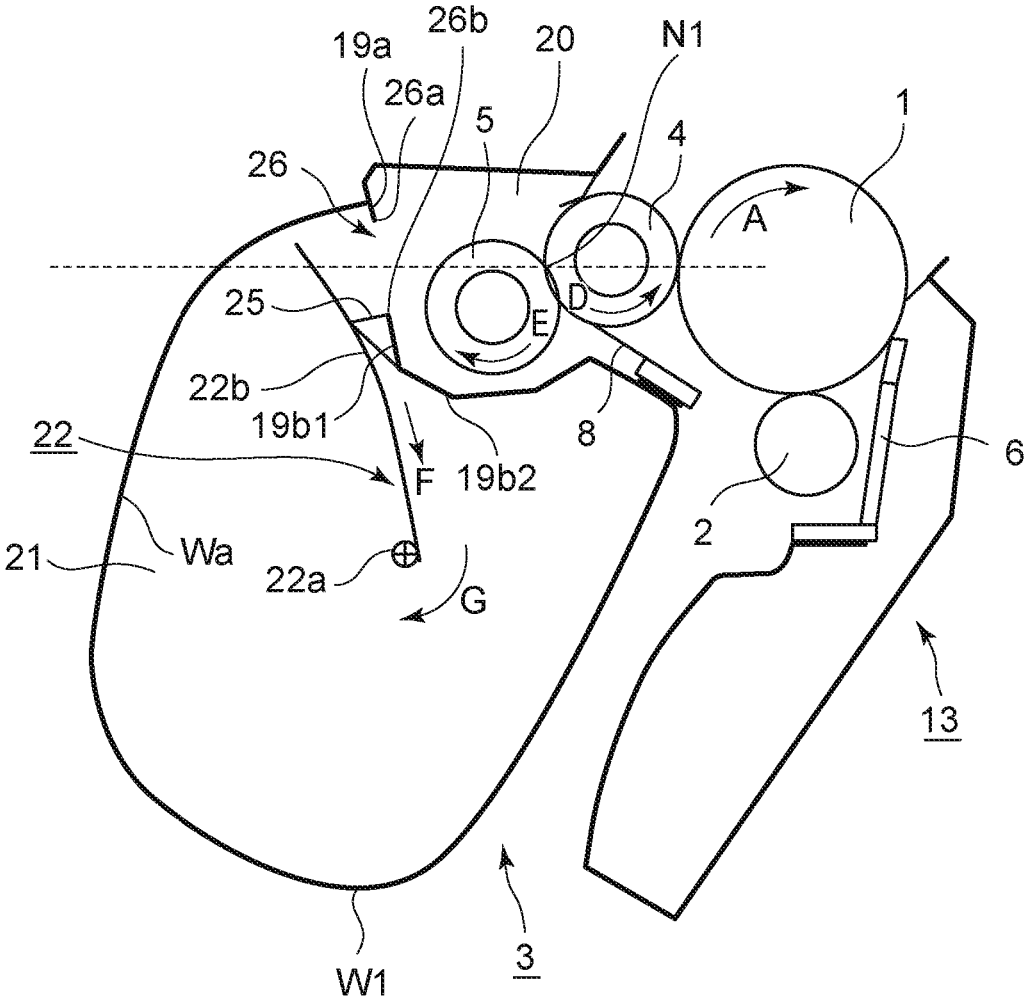
FIG. 8 is a cross-sectional view illustrating a developing device and a process cartridge according to the third embodiment.

The developing unit 3 will be described further with reference to FIG. 7 and FIG. 8. FIG. 7 is a perspective view illustrating the vicinity of the developing opening 26 in the toner containing chamber 21. FIG. 8 is a cross-sectional view illustrating a developing device and a process cartridge according to the present embodiment.

In the present embodiment, the developing unit 3 includes a plurality of the protrusions 25 disposed on the lower wall 19*b* of the partition wall 19 that is located under the developing opening 26. The protrusions 25 are arranged with a spacing therebetween in the rotation axis direction of the rotation shaft 22*a* (i.e., in the longitudinal direction of the developing opening 26). In the present embodiment, five protrusions, in other words, a first protrusion 25*a*, a second protrusion 25*b*, a third protrusion 25*c*, a fourth protrusion 25*d*, and a fifth protrusion 25*e*, are disposed at a plurality of positions with substantially the same spacing provided therebetween in the rotation axis direction of the rotation shaft 22*a*. For example, the width of each protrusion 25 is set at 5 mm, and the spacing between adjacent protrusions 25 is set at 10 mm.

In the present embodiment, as illustrated in FIG. 7, the lower wall 19*b* of the partition wall 19 has a first portion 19*b*1 that extends along the surface in which the developing opening 26 is provided. In addition, the lower wall 19*b* has a second portion 19*b*2 disposed downstream of the first portion 19*b*1 in the rotation direction of the rotation shaft 22*a*. The second portion 19*b*2 extends along a surface intersecting the surface in which the developing opening 26 is provided. The first portion 19*b*1 and the second portion 19*b*2 adjoin each other with a connection portion (corner portion) 19*c* therebetween. Accordingly, the partition wall 19 (the lower wall 19*b*) has a bent shape so as to protrude toward the toner containing chamber 21. In the present embodiment, the protrusions 25 are disposed on the first portion 19*b*1 so as to adjoin the connection portion 19*c*. In addition, in the present embodiment, the protrusions 25 adjoin the developing opening 26 and protrude toward the inside of the toner containing chamber 21 from the surface in which developing opening 26 is provided.

In the present embodiment, as illustrated in FIG. 8, the conveyance sheet 22*b* of the toner conveyance member 22 is able to come into contact with the protrusions 25 while the leading edge 22*b*1 of the toner conveyance member 22 is located above the level of the contact portion upper end N1. In other words, the toner conveyance member 22 according to the present embodiment has such a length that the leading edge 22*b*1 of the toner conveyance member 22 is located above the level of the contact portion upper end N1 in the state where the conveyance sheet 22*b* of the toner conveyance member 22 comes into contact with the protrusions 25.

In the state where the conveyance sheet 22*b* of the toner conveyance member 22 comes into contact with the protrusions 25, gaps are created under the developing opening 26 between the conveyance sheet 22*b* and the partition wall 19.

In the present embodiment, when the conveyance sheet 22*b* reaches the developing opening 26, the conveyance surface of the conveyance sheet 22*b* is in contact with a plurality of the protrusions 25. In spaces between adjacent protrusions 25, gaps are formed between the conveyance surface of the conveyance sheet 22*b* and the partition wall 19. Accordingly, even when the conveyance sheet 22*b* is in proximity to the developing opening 26, the toner that has passed through the developing opening 26 further passes through the gaps between the conveyance sheet 22*b* and the developing opening 26. The toner can move along the sliding surface of the conveyance sheet 22*b* through gaps 19*d* (FIG. 7) between adjacent protrusions 25.

Here, assume a case in which the protrusions 25 are not disposed. In this case, the conveyance sheet 22*b* comes into full contact with the lower wall 19*b* downstream of the developing opening 26. Although a space is provided in an upstream portion of the developing opening 26 between the conveyance sheet 22*b* and the upper wall 19*a*, a downstream portion of the developing opening 26 is closed due to the conveyance sheet 22*b* coming into contact with the lower wall 19*b*. Accordingly, the toner that has passed through the developing opening 26 cannot move downstream along the conveyance sheet 22*b* in the rotation direction of the conveyance sheet 22*b*, which hampers toner movement via the developing opening 26.

On the other hand, in the present embodiment, the protrusions 25 protrude toward the inside of the toner containing chamber 21 from the surface in which developing opening 26 is provided. This causes the conveyance sheet 22*b* to open in such a manner that the leading edge 22*b*1 moves away from the developing opening 26 with protrusions 25 as fulcrums when the leading edge 22*b*1 of the conveyance sheet 22*b* is released from contact with a releasing wall surface Wa. Thus, the conveyance sheet 22*b* does not close the developing opening 26. As described above, in the present embodiment, the conveyance sheet 22*b* can be prevented from hampering toner movement through the developing opening 26 every time the rotation shaft 22*a* rotates. Moreover, a flow path of toner indicated by arrow F in FIG. 8 can be formed. Toner returning from the developing chamber 20 to the toner containing chamber 21 moves along the toner flow path to a downstream region in the rotation direction of the conveyance sheet 22*b*. As a result, hampering toner circulation between the developing chamber 20 and the toner containing chamber 21 every time the rotation shaft 22*a* rotates is suppressed. Thus, quality images can be formed stably.

[Experiment]

The image density evaluation described in the first embodiment was also conducted for the present embodiment. The same experiment was conducted on the comparative examples described below for comparison of effects.

Comparative Example 3A

The configuration of Comparative Example 3A was such that the lower wall 19*b* did not have the protrusions 25 and the features other than the protrusions 25 were the same as those of the third embodiment. In other words, Comparative Example 3A had the same configuration as that of the Comparative Example 1.

Comparative Example 3B

The configuration of Comparative Example 3B was the same as that of Comparative Example 2 described above.

The evaluation results are collated in Table 3.

TABLE 3

| Toner amount in toner containing chamber | Third embodiment | Comparative example 3A | Comparative example 3B |
|---|---|---|---|
| 50 g | A | A | C |
| 200 g | A | B | A |
| 400 g | A | C | A |

With the present embodiment, the density difference was hardly observed for the three cases of toner amount, in other words, for the toner amounts of 50 g, 200 g, and 400 g. This is because due to the protrusions 25 protruding toward the inside of the toner containing chamber 21, the conveyance sheet 22*b* does not close the downstream portion of the developing opening 26 and the flow path of toner is formed.

On the other hand, the density difference was large for Comparative Example 3A when a large amount of toner was present. With this configuration, the height of the toner near the opening in the developing chamber 20 becomes higher than the level of the upstream end, in the rotation direction, of the contact portion between the supply roller 5 and the developing roller 4 when the amount of toner in the toner containing chamber 21 was large and accordingly the amount of toner supplied by the toner conveyance member 22 was large. Consequently, the toner near the opening hampers the toner flow caused by rotation of the supply roller 5 from the developing chamber 20 to the toner containing chamber 21. As a result, toner supplied from the temporary toner reservoir V to the contact portion N is hampered, which causes the developing roller 4 to receive an insufficient amount of toner thereon and causes the image density decrease. This phenomenon occurs when the conveyance sheet 22*b* comes closer to the developing opening 19 during rotation of the toner conveyance member 22.

With the configuration of the Comparative Example 3B, the image density difference became large when the amount of toner was small. With the configuration of Comparative Example 3B, the image density decrease due to the height of the toner near the opening becoming H2 or more did not occur. However, when the toner amount in the toner containing chamber was small, toner conveyed to the temporary toner reservoir V became insufficient, which leads to the image density decrease.

In summary, with the configuration according to the present embodiment, the image density decrease can be also suppressed.

In the present embodiment, the protrusions 25 are disposed on the first portion 19*b*1. However, the protrusions 25 may be disposed on the second portion 19*b*2. In addition, it is preferable to provide a plurality of the protrusions 25 because toner flow paths can be formed easily. However, for example, a single protrusion 25 may be disposed in a center area in the rotation axis direction of the rotation shaft 22*a* so as to form toner flow paths on both sides of the protrusion 25.

In the present embodiment, spacing is provided between the conveyance sheet 22*b* and the upper edge of the developing opening 26. However, even in the case where the conveyance sheet 22*b* covers the entire developing opening 26, the similar effect can be obtained.

The first, second, and third embodiments have been described. All or some of the configurations of the embodiments can be appropriately combined with each other when necessary. In other words, all or some of portions of the configurations of the first, second, and third embodiments can be combined with each other.

In each embodiment, an image forming apparatus capable of forming color images has been described by way of example. However, the invention is not limited to this. The image forming apparatus may be capable of forming monochrome images.

In each embodiment, a printer has been described as an example of the image forming apparatus. However, the invention is not limited to this. For example, the image forming apparatus may be an image forming apparatus of other type, such as a copier, a facsimile, or a multifunction printer that combines these functions. The image forming apparatus may be an image forming apparatus that employs a recording medium bearing member. Toner images of different color are overlaid consecutively on each other and transferred on a recording medium that is born by the recording medium bearing member.

In each embodiment, the process cartridge is detachably installed in the image forming apparatus. However, the process cartridge may be fixed to the image forming apparatus.

Alternatively, each of the developing unit and the photosensitive member unit may be detachably installed in the image forming apparatus. Moreover, the process cartridge from which the developing unit and the photosensitive member unit can be detached can be detachably installed in the image forming apparatus while the developing unit and the photosensitive member unit are installed in the process cartridge.

According to the embodiments described above, the developing device can suppress hampering of developer circulation even in the case where a conveyance member is made longer in a system in which developer is returned from a developing chamber to a developer containing chamber via an opening provided in a partition wall that separates the developing chamber and the developer containing chamber from each other.

While the disclosure has been described with reference to example embodiments, it is to be understood that the invention is not limited to the disclosed example embodiments. The scope of the following claims is to be accorded the broadest interpretation so as to encompass all such modifications and equivalent structures and functions.

This application claims the benefit of Japanese Patent Application No. 2017-183525 filed Sep. 25, 2017, which is hereby incorporated by reference herein in its entirety.

What is claimed is:

1. A developing device comprising:

a developer bearing member that bears developer;

a supply member that comes into contact with the developer bearing member and thereby supplies the developer to the developer bearing member;

a developing chamber in which the developer bearing member and the supply member are disposed;

a developer containing chamber that contains the developer and at least part of which is positioned at a level below the developing chamber;

a partition wall that partitions the developing chamber and the developer containing chamber from each other and is provided with an opening, the opening communicates the developing chamber and the developer containing chamber with each other, a lower edge of the opening is positioned at a level below an upper end of a contact portion formed by the supply member and the developer bearing member; and a conveyance member that is rotatably disposed within the developer containing chamber and that conveys the developer from the developer containing chamber to the developing chamber via the opening and is provided with a hole through which the developer can pass, wherein the developer bearing member and the supply member rotate in such a manner that movement directions of respective surfaces of the developer bearing member and the supply member at the contact portion include a downward component in a gravity direction, and wherein in a state where a leading edge of the conveyance member is positioned at a level above the upper end of the contact portion, a lower edge of the hole is positioned at a level below the upper end of the contact portion and an upper edge of the hole is positioned at a level above the lower edge of the opening.

2. The developing device according to claim 1, wherein in a state where the leading edge of the conveyance member is positioned at a level above the upper end of the contact portion, the lower edge of the hole is positioned at a level below the lower edge of the opening.

3. The developing device according to claim 1, wherein in a state where the leading edge of the conveyance member is positioned at a level above the upper end of the contact portion, the upper edge of the hole is positioned at a level below the upper end of the contact portion.

4. The developing device according to claim 1, wherein in a state where the leading edge of the conveyance member is positioned at a level above the upper end of the contact portion, the upper edge of the hole is positioned at a level above the upper end of the contact portion.

5. The developing device according to claim 1, wherein the conveyance member is provided with a plurality of the holes that are disposed at positions arranged in a direction of a rotation axis of the conveyance member.

6. The developing device according to claim 1, wherein the conveyance member deforms due to the leading edge coming into contact with an interior wall of the developer containing chamber and the developer is thrown toward the opening due to the conveyance member releasing from deformation.

7. A process cartridge comprising:

the developing device according to claim 1; and an image bearing member to which the developer bearing member supplies the developer.

8. An image forming apparatus, comprising:

an apparatus body;

the developing device according to claim 1; and an image bearing member to which the developer bearing member supplies the developer.

9. An image forming apparatus comprising:

an apparatus body and the process cartridge according to claim 7.

10. A developing device comprising:

a developer bearing member that bears developer;

a supply member that comes into contact with the developer bearing member and thereby supplies the developer to the developer bearing member;

a developing chamber in which the developer bearing member and the supply member are disposed;

a developer containing chamber that contains the developer and at least part of which is positioned at a level below the developing chamber;

a partition wall that partitions the developing chamber and the developer containing chamber from each other and is provided with an opening, the opening communicates the developing chamber and the developer containing chamber with each other, a lower edge of the opening is positioned at a level below an upper end of a contact portion formed by the supply member and the developer bearing member; and a conveyance member that is rotatably disposed within the developer containing chamber and that conveys the developer from the developer containing chamber to the developing chamber via the opening and has a protrusion that can come into contact with the partition wall, wherein the developer bearing member and the supply member rotate in such a manner that movement directions of respective surfaces of the developer bearing member and the supply member at the contact portion include a downward component in a gravity direction, and wherein in a state where a leading edge of the conveyance member is positioned at a level above the upper end of the contact portion, the protrusion comes into contact with the partition wall and a gap is thereby created between the conveyance member and the partition wall.

11. The developing device according to claim 10, wherein the conveyance member includes a plurality of the protrusions that are disposed at positions arranged in a direction of a rotation axis of the conveyance member.

12. The developing device according to claim 10, wherein the protrusion comes into contact with the partition wall at a level below the lower edge of the opening.

13. The developing device according to claim 10, wherein the conveyance member deforms due to the leading edge coming into contact with an interior wall of the developer containing chamber and the developer is thrown toward the opening due to the conveyance member releasing from deformation.

14. A process cartridge comprising:

the developing device according to claim 10; and an image bearing member to which the developer bearing member supplies the developer.

15. An image forming apparatus, comprising:

an apparatus body;

the developing device according to claim 10; and an image bearing member to which the developer bearing member supplies the developer.

16. An image forming apparatus, comprising:

an apparatus body and the process cartridge according to claim 14.

* * * * *